United States Patent [19]

Williams

[11] Patent Number: 4,768,312

[45] Date of Patent: Sep. 6, 1988

[54] RAIL GRINDING MACHINE

[75] Inventor: Christopher Williams, South Burnaby, Canada

[73] Assignee: Williams & White Machine Shop Ltd., British Columbia, Canada

[21] Appl. No.: 22,431

[22] Filed: Mar. 6, 1987

[51] Int. Cl.[4] ..... E01B 31/17

[52] U.S. Cl. ..... 51/178

[58] Field of Search ..... 51/170 R, 178, 170 EB, 51/241 LG, 281 R

[56] References Cited

U.S. PATENT DOCUMENTS 3,090,170 5/1963 Slattery ..... 51/178

4,249,346 2/1981 Theurer ..... 51/178

*Primary Examiner*—Roscoe V. Parker

*Attorney, Agent, or Firm*—Christie, Parker & Hale

[57] ABSTRACT

Apparatus to grind the rail of a track. The apparatus includes a contoured wheel having an outer surface of a predetermined contour. An abrasive belt is supported by the contoured wheel. At least one driven wheel receives the belt and drives the belt. There is a motor to drive the driven wheel and a chassis to carry the apparatus over the track.

10 Claims, 2 Drawing Sheets

RAIL GRINDING MACHINE

FIELD OF THE INVENTION

This invention relates to an apparatus that grinds the rail of a track.

DESCRIPTION OF THE PRIOR ART

In forming a railroad track there are inevitably joints between adjacent sections of rail. Although many years ago expansion gaps would be left between the rails this is no longer the case. The sections of rail are welded together to produce a continuous track.

The forming of joints in this way is a means of avoiding track noise. Unfortunately it is not entirely successful. Where the rail is welded together it can mean a projection both on the top and the side of the track. Furthermore, there are inevitably undulations in the track and these irregular surfaces contribute to noise.

The joints are ground after welding to produce a reasonably smooth, continuous surface but the grinding of the joints is time consuming, difficult task. Typically a grinding wheel is hand held. Alternatively, grinding stones mounted on a vehicle that can traverse the track, are used. The grinding stones are flat and are, as is conventional, rotated rapidly and forced against the rail.

The results achieved are not ideal. There are still instances where the prior art grinding systems are not successful in smoothing the track. Some wheel noise is inevitable with the prior art systems.

SUMMARY OF THE INVENTION

The present invention seeks to improve the grinding of tracks to ensure a smooth surface, greatly reducing the noise produced as the metal wheel of the train passes over the track.

Accordingly, the present invention provides an apparatus to grind the rail of a track, the apparatus comprising: a contoured wheel having an outer surface of a predetermined contour; an abrasive belt supported by the contoured wheel; at least one driven wheel to receive the belt and drive the belt; means to drive the driven wheel; and a chassis to carry the apparatus over the track.

In a preferred embodiment the contoured wheel has a concave outer surface to receive the upper convex surface of the rail.

In a further aspect the present invention is a method of grinding a rail of a track that comprises grinding the rail with a driven abrasive belt supported by a wheel having an outer surface of a predetermined contour.

BRIEF DESCRIPTION OF THE DRAWINGS

Aspects of the invention are illustrated, merely by way of example, in the accompanying drawings in which.

DESCRIPTION OF THE PREFERRED EMBODIMENTS

Figure 2:
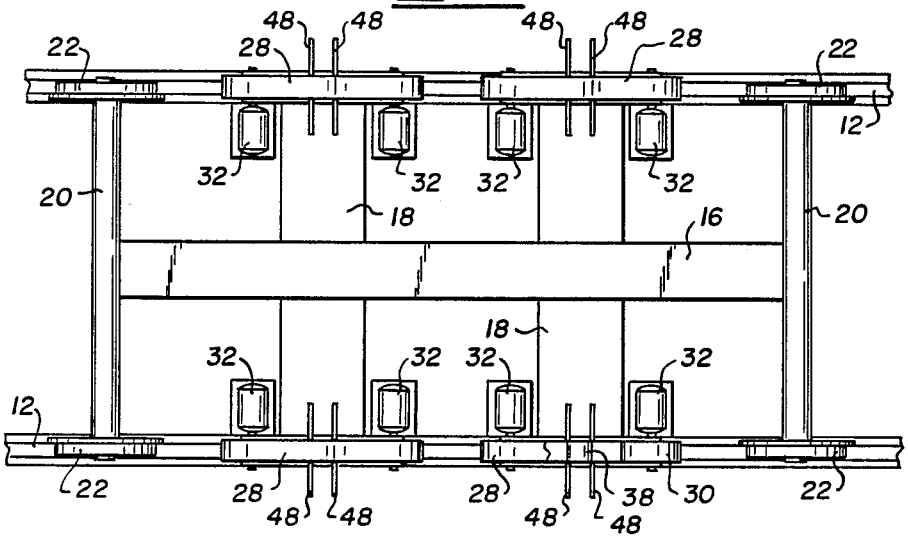
FIG. 2 is a plan view of the chassis of the apparatus of the present invention.
Figure 3:
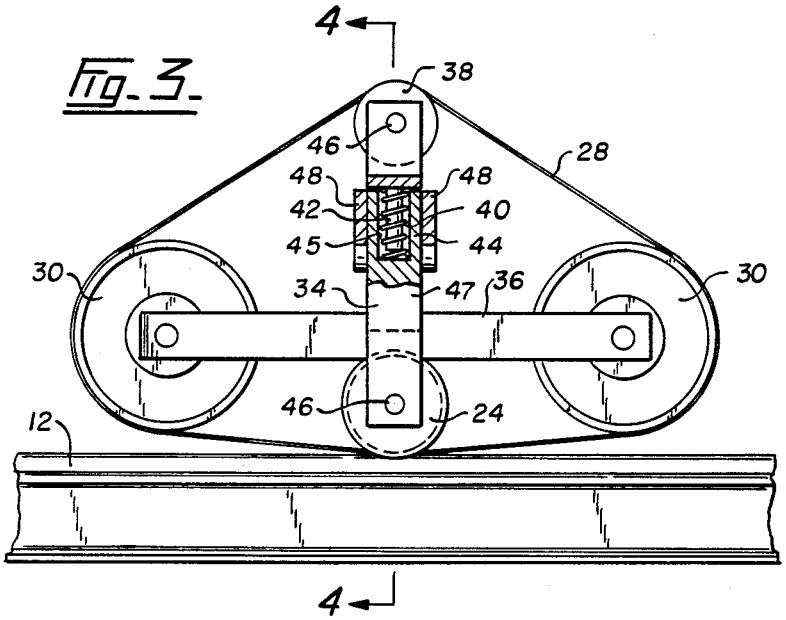
FIG. 3 is a detail of the apparatus of FIG. 1.

The drawings show an apparatus 10 to grind a rail 12 of a track. As shown particularly in FIG. 1, the apparatus 10 may comprise a locomotive with a conventional engine, and means to transmit drive to the drive wheels on the track. There is a cab 14 for the operator. The locomotive has a chassis made up of longitudinal members 16, cross members 18, axles 20 and wheels 22, and includes an independently driven apparatus to grind the rails 12 of the track. The grinding apparatus comprises a contoured wheel 24, as shown most clearly in FIGS. 3 and 4, having an outer surface 26 of a predetermined contour. There is an abrasive belt 28 supported by the contoured wheel 24 and at least one driven wheel 30 to receive the belt 28 and drive the belt 28. FIGS. 2 and 3 show two driven wheels 30, each mounted at the end of a cross member 18 and each provided with a motor 32. There is an upright 34 attached to a longitudinal member 36 and the contoured wheel 24 is attached to the lower end of the upright 34. At the upper end of upright 34 there is an idler wheel 38. The upright 34 desirably includes means to urge the contoured wheel 24 and the idler wheel 38 apart to maintain tension in the belt 28. As illustrated a spring 40 is mounted on a shaft 42 attached to an upper part 44 of the upright 34. The shaft 42, surrounded by the spring 40, is received within a recess 45 in the upper end of a lower part 47 of the upright 34.

Figure 4:
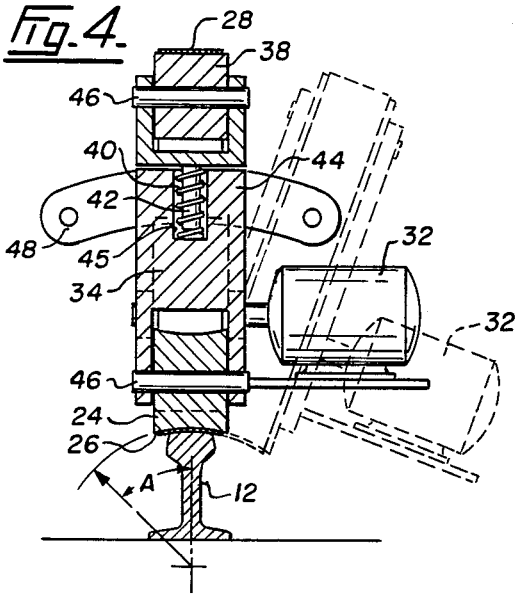
FIG. 4 is a section on the line of 4—4 in FIG. 3.

FIG. 4 illustrates the typical concave outer surface 26 to receive the upper convex surface of the rail 12 and also illustrates that both the driven and the contoured wheel 38 and 24 are mounted on shafts 46 journalled in housings at opposed ends of the longitudinal member 34.

FIG. 4 shows that it is possible to vary the presentation of the angle of the contoured wheel 24 to the rail 12. As shown in FIG. 4, and in FIG. 2, lateral guide members 48 are mounted on the chassis to receive the upright 34. There are means, for example, bolts or pins, to releasably attach the upright 34 to the guide members 48 at predetermined relative angles A—see FIG. 4.

Figure 5:
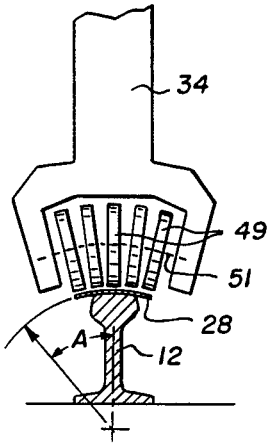
FIG. 5 illustrates a detail of a further embodiment of the invention.

FIG. 5 illustrates an embodiment of the invention in which the contoured wheel comprises a plurality of independently mounted flat rollers 49, rotatably mounted on a curved shaft 51 to provide the necessary contoured outer surface. The belt 28 is supported by the rollers 50 in a manner precisely the same as the support of the belt 28 by the contoured wheel 24 in FIGS. 3 and 4.

Figure 6:
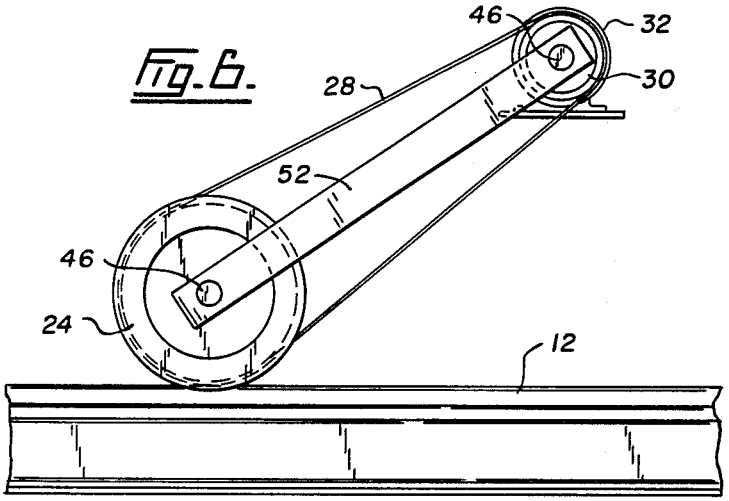
FIG. 6 is a side elevation of yet another embodiment of the invention.
Figure 7:
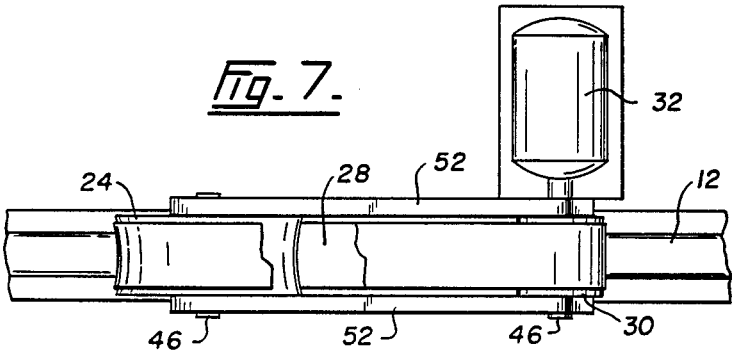
FIG. 7 is a plan view of the embodiment of FIG. 6.

FIG. 6 illustrates an embodiment of the invention having a motor 32 mounted on the chassis to drive the driven wheel 30. Only one such arrangement is shown but there may be a plurality, typically three, motors 32 each driving a driven wheel 30. A longitudinal member 52 is attached to the driven wheel 30 and the contoured wheel 24. As shown particularly in FIG. 7, the longitudinal member 52 comprises spaced apart bar that receives the driven and contoured wheels between them on axles 46. There are means, not shown, urging the contoured wheel 24 downwardly into contact with the rail 12 with predetermined, relatively high, pressure.

Typically the radius of curvature of the concave outer surface will be about 10° or more.

Figure 1:
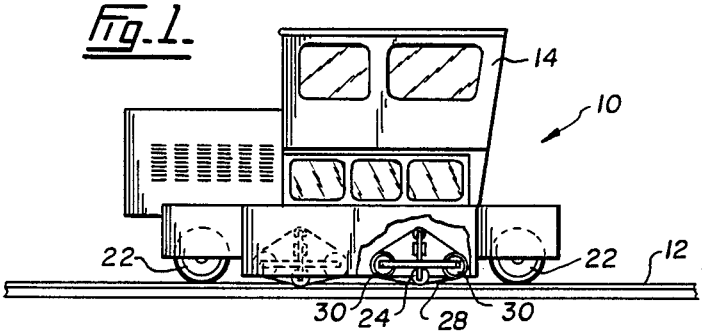
FIG. 1 is a side elevation, partially broken away, of an apparatus according to the present invention.

In using the present invention the locomotive 10, as shown in FIG. 1, is driven over part of the track 12. The motors 32 are run. The motors 32 may be hydraulic, electric or internal combustion engines but will normally be hydraulic or electric. With the motors 32 running the wheels 30 drive the belts 28. The contoured wheel 24, in contact with the rail 12, shapes the belt 28 as it passes between the wheel 24 and the rail 12 to grind the rail surface to a predetermined contour.

Should it be necessary, the angle of application may be varied, as shown in FIG. 4.

Thus the present invention provides a simple yet extremely effective way of controlling the contour of a rail. Excellent results have been obtained in experiments conducted. The machine grinds longitudinally of the track, avoiding tranverse cracks that can weaken rails. It also removes any small amounts of metal, which is a virtue in ensuring track longevity.

I claim:

1. Apparatus to grind the rail of a track, the apparatus comprising:

a contoured wheel having an outer surface of a predetermined contour comprised of a plurality of flat rollers mounted to define the predetermined contour;

an abrasive belt supported by the contoured wheel;

at least one driven wheel to receive the belt and drive the belt;

means to drive the driven wheel; and a chassis to carry the apparatus over the track.

2. Apparatus as claimed in claim 1 in which the contoured wheel has a concave outer surface to receive the upper, convex surface of the rail.

3. Apparatus as claimed in claim 1 including means to maintain tension in the belt.

4. Apparatus as claimed in claim 1 having a motor mounted on the chassis to drive the driven wheel;

a longitudinal member attaching the driven wheel and the contoured wheel;

means urging the contoured wheel downwardly into contact with the rail.

5. Apparatus as claimed in claim 4 in which the longitudinal member comprises spaced apart bars that received the driven and the contoured wheels between them.

6. Apparatus to grind the rail of a track, the apparatus comprising:

a chassis to move along the track;

a frame including a longitudinal member mounted on the chassis;

belt support wheels mounted at each end of the longitudinal member;

a motor to drive each belt support wheel;

an upright attached to the longitudinal member;

a contoured wheel having an outer surface of a predetermined contour attached to a lower end of the upright;

an idler wheel at an upper end of the upright; and an abrasive belt supported by the contoured wheel and the idler wheel and extending around the belt support wheels at each end of the longitudinal member.

7. Apparatus as claimed in claim 6 including means in the upright tending to urge the contoured wheel and the idler wheel apart to maintain tension in the belt.

8. Apparatus as claimed in claim 7 which the means to urge the contoured wheel and the idler wheel apart is a spring.

9. Apparatus as claimed in claim 6 including means to allow a variation of the presentation of the angle of the contoured wheel to the rail.

10. Apparatus as claimed in claim 8 having lateral track members mounted on the chassis to receive the upright; and means to releasably attach the upright to the lateral track members at predetermined, relative angles.

* * * * *